United States Patent [19]

Suzuki

[11] 4,454,727

[45] Jun. 19, 1984

[54] DEHUMIDIFICATION AIR-CONDITIONING METHOD WITH SOLAR HEAT

[76] Inventor: Soohei Suzuki, 1-12, Ebisu-cho, Gihu-shi, Japan, 100

[21] Appl. No.: 269,055

[22] PCT Filed: Oct. 30, 1979

[86] PCT No.: PCT/JP79/00279

§ 371 Date: Jun. 30, 1981

§ 102(e) Date: May 28, 1981

[87] PCT Pub. No.: WO81/01326

PCT Pub. Date: May 14, 1981

[51] Int. Cl.[3] ..... F25B 27/00

[52] U.S. Cl. ..... 62/235.1; 62/476

[58] Field of Search ..... 62/271, 235.1, 269, 62/94, 476

[56] References Cited

U.S. PATENT DOCUMENTS 2,690,656 10/1954 Cummings ..... 62/94
4,164,125 8/1979 Griffiths ..... 62/271
4,205,529 6/1980 Ko ..... 62/271

FOREIGN PATENT DOCUMENTS 257969 3/1913 Fed. Rep. of Germany ..... 62/271

*Primary Examiner*—Albert J. Makay
*Assistant Examiner*—Henry Bennett
*Attorney, Agent, or Firm*—Jordan and Hamburg

[57] ABSTRACT

A concentrated solution to be utilized for dehumidification is housed in a concentrated solution tank and is supplied to a dehumidification room to dehumidify the air. The resulting dilute solution is collected in a dilute solution tank and is condensed into a concentrated solution by a vacuum vaporation process. The resulting concentrated solution is returned to the concentrated solution tank. In the vacuum vaporation process, the dilute solution housed in the dilute solution tank is converted into a heated dilute solution through a heat exchanger. The heated solution is heated by solar energy in a low temperature vaporizer and a high temperature vaporizer in which the pressure is reduced by a source of vacuum. The heated dilute solution is returned to the concentrated tank through a heat exchanger.

7 Claims, 2 Drawing Figures

DEHUMIDIFICATION AIR-CONDITIONING METHOD WITH SOLAR HEAT

BACKGROUND OF ART

In the conventional dehumidification air-conditioning and method utilizing solar heat, the mechanism is large-scaled in size and low in working efficiency. Also it is difficult for the conventional method to make equal use of solar energy stored in the summer and provide in the winter. Accordingly, an object of this invention is to provide an improvement of the conventional method by using a multistage sun collector, solutions for use in providing dehumidification such as a calcium chloride solution and a vacuum vaporation process.

Description of the Preferred Embodiments

Figure 1:
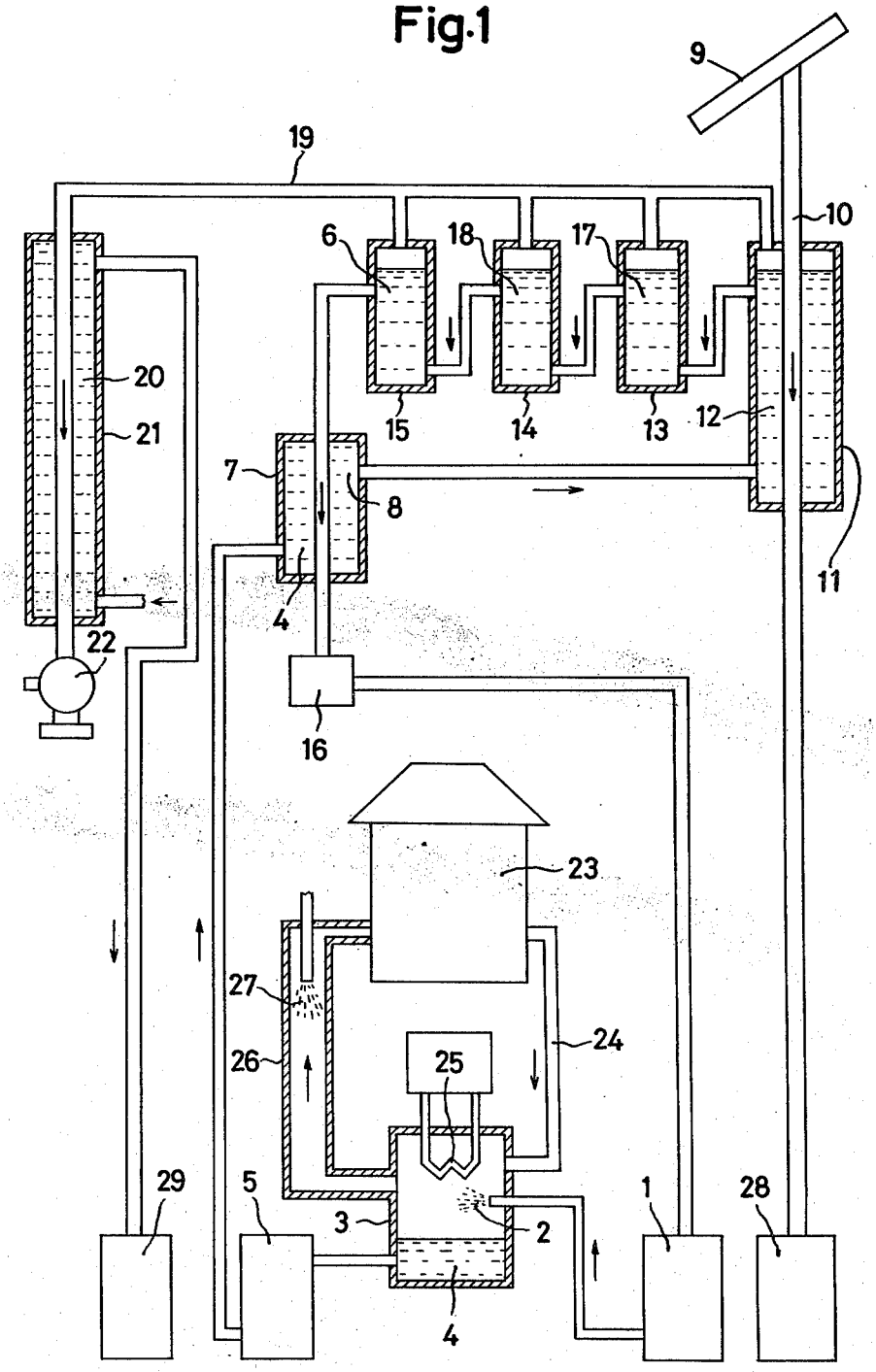
FIG. 1 is a schematic view partly cut away and in section of a system according to one embodiment of the present invention.

Referring first FIG. 1, a concentrated solution storage tank (1) stores a concentrated desiccant solution (2) for use in providing dehumidification. Any kind of solution which provided for dehumidification may be used, but the explanation will be directed to calcium chloride for convenience.

The concentrated solution (2) is passed to a dehumidification room (3) by a pump (32) and dehumidifies the air within the room (3) by a spray method for example. The solution (2) which absorbs moisture is thereby a dilute solution (4). This solution (4) is housed in a dilute solution tank (5). This dilute solution (4) is collected into a concentrated solution (6) through a vacuum evaporation process, and the resulting solution (6) is returned to the tank (1).

The vacuum evaporation process is carried out as follows.

The dilute solution (4) in the tank (5) is pre-heated by a heat exchanger 7 to provide a heated dilute solution (8). The resulting pre-heated solution (8) is converted into a mid-concentrated solution (12) in a relatively low temperature evaporator (11) heated by hot water (10) in a pipe connected to a flat-type sun collector (9). The constitution of the flat-type sun collector (9) is well known and therefore its explanation will be omitted.

The mid-concentrated solution (12) is converted into a concentrated solution (6) through high temperature evaporators (13) (14) (15) heated by collected light sun collectors. The resulting solution (6) is pumped by pump (30) and is cooled by the dilute solution (4) passing through the heat exchanger (7) and is returned to the tank (1) by way of a receiving tank (16) and pump (31). The collected light sun collectors collect solar heat with light collecting mirrors (13*a*), (14*a*), (15*a*). The heating temperature of the collected light sun collector is higher than that of the flat-type sun collector (9). The conventional sun collector is available for the collected light sun collectors. The light collecting mirrors heat the three high temperature vaporizers (13) (14) (15), however the number of evaporators is not limited to three. The mid-concentrated solution (12) is converted into a second mid-concentrated solution (17) in the evaporator (13), and the resulting solution (17) is converted into a third mid-concentrated solution (18) in the evaporator (14). Then the resulting solution (18) is converted into the concentrated solution (6) in the evaporator (15).

A vacuum pipe (19) connects the head portion of the low temperature vaporizer (11) with the high temperature vaporizers (13) (14) (15) and is cooled by a coagulation device (21) through utilizing cooling water. A vacuum pump (22) reduces pressure in the vacuum pipe (19). Thus the vacuum facilitates evaporation of the solution.

Air in a room (23) of a house and the like is introduced to the dehumidification room (3) through an entry pipe. Then the air is dehumidified by the concentrated desiccant solution (2) and simultaneously cooled and dehumidified by a refrigerator (25). The cooled air is returned to the room (23) of the house and the like through an exit pipe (26). If necessary, spray water is provided within the pipe (26). In addition, the room (3) may be heated, for example, by the atmosphere or steam or air including steam from general water. The air within the room (3) or the air heated by the air within the room (3) is returned to the room (23) of the house and the like again.

Figure 2:
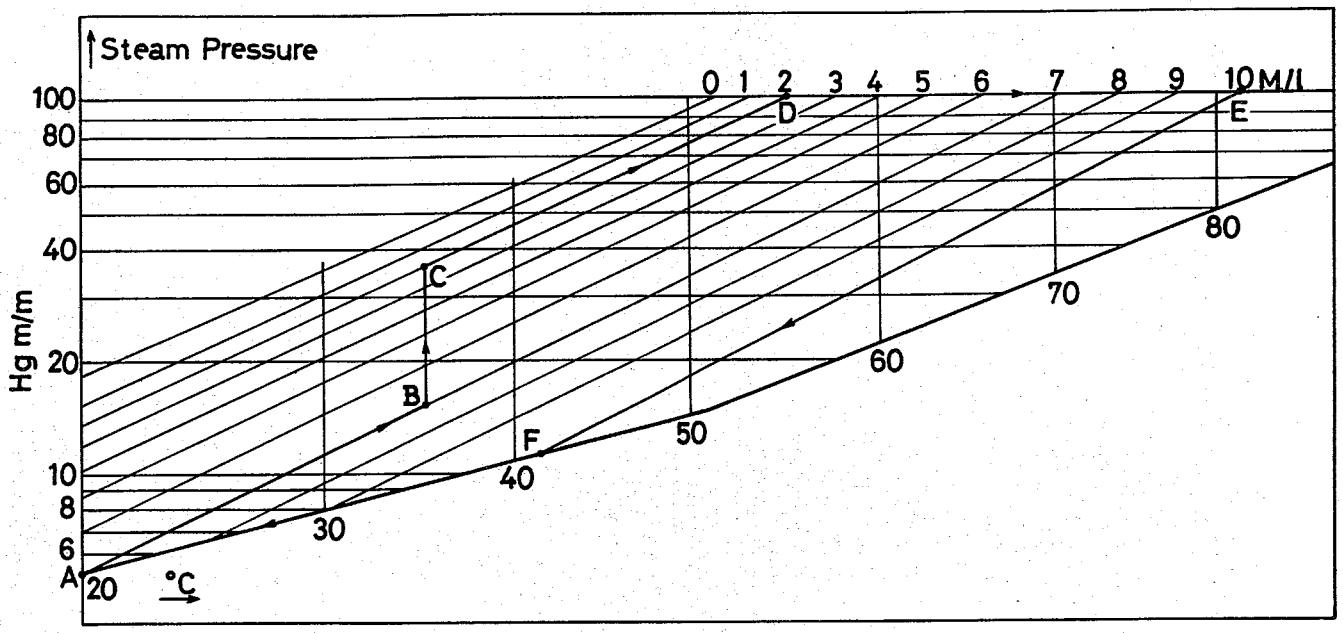
FIG. 2 is a view of the vaporation pressure line showing M/1 of calcium chloride as a parameter.

A further explanation about the vacuum vaporation process will be quantitatively made with FIG. 2 illustrating the vapor pressure line of the calcium chloride solution.

The pressure within the vacuum pipe (19) is defined as 100 Hgm/m.

Point A shows a condition where the concentrated solution (2) is stored in the storage tank (1) at 20° C. The solution (2) is subjected to the outer temperature on the way from the storage tank (1) to the dehumidification room (3). After the temperature of the solution (2) reaches 35° C., it goes up along a line of 7 M/l from the point A, and, at a point B, the solution (2) is sprayed into the room (3). At this time, if the room (3) is held at 35° C. by the refrigerator (25), the solution (2) will be diluted into 2 M/l solution and then reach to a point C. If cooling is not done, the point C will go up along a line of 2 M/l. The 2 M/l dilute solution (4) is pre-heated by the heat exchanger (7) and becomes pre-heated dilute solution (8). This fact indicates that the solution (4) reaches to a point D on the line of 2 M/l. If the pre-heated dilute solution (8) passes through the low temperature vaporizer (11) which is at a pressure of 100 Hgm/m and the high temperature vaporizers (13) (14) (15) which also are at a pressure of 100 Hgm/m the resulting solution (6) is condensed into 10 M/l, and will reach to a point E along a line of 100 Hgm/m from the point D. The pre-heated dilute solution (8) is heated up to the point of 55° C. in the heat exchanger (7), and the mid-concentrated, the second and the third solutions are heated, for example, up to 60° C., 68° C. and 75° C. respectively. The concentrated solution (6) is heated up to 83° C. The solution (6) is cooled by the heat exchanger (7) and goes down along the line of 10 M/l. Then the solution (6) reaches the solidus area, for example, at a point F of 42° C. After passing the heat exchanger (7), the solution (6) passes into the concentrated solution storage tank (1) and is naturally cooled down to, for example, 20° C. facing the solidus area. Thus the solution is returned to the initial point A. M/l is the mole concentration per liter of water. Temperature below the point F precipitates calcium chloride and the solution (6) is diluted gradually within the tank (1). At the point A, the concentration of the solution (6) is diluted to 7 M/l. While the solution (6) is returned from F to A, the initial precipitation may occur inthe receiving tank (16).

Reduction of pressure in the tank (16) by the vacuum pump makes it easy to transfer the solution (6) to the tank (16).

The hot water (10) with its temperature reduced on passing through the low temperature vaporizer (11) is stored in a mid-hot-water tank (28).

The cooling water (20) with its temperature increased through a coagulation device (21) is stored in a low-hot-water tank (29).

In the refrigerator (25), the air-cooling or water-cooling of a combination of both is available.

In the systematic view of an embodiment of the invention as shown in FIG. 1, opening-closing valves are not illustrated. The arrows in FIG. 1 show the transfer direction of the solution.

The working and effects of the present invention are as follows.

The air in the room (23) of the house and the like is introduced into the dehumidification room (3) through the entry pipe (24) and dehumidified. The resulting dehumidified air is returned to the room (23) of the house and then dehumidifies the air within the room (23). That is, the dehumidification decreases the discomfort index.

The air in the room (23) is dehumidified in the dehumidification room (3). Spray water is provided within the exit pipe (26) so that the humidity therein is moderated. As a result, the air is cooled by the vaporization of the water (27). That is, the room (23) and the like are cooled.

In case the refrigerator (25) is not turned on and the atmosphere is introduced to the room (3), the atmosphere is heated by heat generation which occurs when the concentrated solution (2) absorbs steam in the atmosphere. The resulting atmosphere can heat the room (23) and the like. Instead of the atmosphere, it may be possible to utilize air including steam or water heated by solar heat.

In the solid phase, calcium chloride is a hexahydrate salt below a dislocation point of about 30° C. and corresponds to about 10 M/l in concentration, a tetrahydrate salt and about 15 M/l in about between 30° C. and 45° C., and a dihydrate salt and about 31 M/l above 45° C. Accordingly, calcium chloride in the solid phase is equal to a high-concentrated solution, and has the potential ability for dehumidification.

Therefore, in use of solar energy in accordance with the present invention, for example, if the calcium chloride solution is condensed into the solid phase by using solar energy in the summer, it will be possible to utilize dehumidification heating in the winter when adequate solar energy is lacking. That is, the invention can store solar energy and use it whenever necessity requires. Further, the invention makes it possible to equalize the use of solar energy all year round.

The present invention utilizes effectively solar energy by adopting vacuum vaporization in low-temperature and the high-temperature vaporizers, and by acquiring the heat of the concentrated solution and giving it to the dilute solution in the heat exchanger. Therefore, the energy efficiency is high. Accordingly it is possible to make the whole device comparatively compact.

Hot water in the tank (28) and the tank (29) may be appropriately used.

As will be apparent from above description of the invention, the faults of the conventional dehumidification air conditioning method with solar heat are improved by the present invention.

What we claim is:

1. A dehumidification air-conditioning method utilizing solar heat comprising:

supplying a concentrated desiccant solution from a concentrated desiccant solution tank to a dehumidification room to which air is conducted from the interior of a house;

dehumidifying the air in said room by utilizing said concentrated solution whereby said concentrated solution is diluted;

collecting the used dilute solution in a dilute solution tank;

pre-heating the dilute solution by utilizing a heat exchanger;

passing said pre-heated dilute solution through a low-temperature vacuum evaporation means for withdrawing moisture therefrom in order to acquire a mid-concentrated solution;

utilizing simultaneously solar heat and vacuum in said low-temperature vacuum evaporation means in order to acquire said mid-concentrated solution;

passing said mid-concentrated solution to a plurality of high-temperature vacuum evaporation means arranged in series for further withdrawing moisture from said mid-concentrated solution in order to acquire a concentrated solution;

utilizing sunlight heat reflected from light collecting mirrors on each of said high-temperature vacuum evaporation means in order to directly heat said high-temperature vacuum evaporation means to thereby acquire said concentrated solution;

applying a reduced pressure to said low-temperature vacuum evaporation means and to each of said plurality of high-temperature vacuum evaporation means by communicating a source of vacuum thereto;

passing said concentrated solution from said high-temperature vacuum evaporation means to said heat exchanger such that said concentrated solution is cooled in said heat exchanger; and returning said concentrated solution to said concentrated desiccant solution tank.

2. A method according to claim 1 wherein said concentrated desiccant solution is supplied from said concentrated desiccant solution tank to said dehumidification room by spraying said concentrated desiccant solution into said dehumidification room, and wherein said collecting of said dilute solution in said dilute solution tank comprises disposing said dilute solution tank at the bottom of said dehumidification room for collecting said sprayed solution.

3. A method according to claim 1 comprising cooling a vacuum conditioned pipe which provides said reduced pressure from said source of vacuum.

4. A method according to claim 1 comprising cooling the air in the dehumidification room by refrigerator means.

5. A method according to claim 4 wherein said air from said dehumidifying room is returned to said house through an exit conduit, and further comprising spraying water into the air in said exit conduit.

6. A method according to claim 1 comprising heating the air in the dehumidification room.

7. A method according to claim 6 wherein said air in the dehumidification room is heated by utilizing the heat released when the moisture in the air in said dehumidification room is absorbed by the concentrated desiccant solution.

* * * * *